US008295536B2

(12) United States Patent
Carlmark et al.

(10) Patent No.: US 8,295,536 B2
(45) Date of Patent: Oct. 23, 2012

(54) MOVING MAGNET LEVERED LOUDSPEAKER

(75) Inventors: Richard Tucker Carlmark, Cumberland, RI (US); Geoffrey C. Chick, Norfolk, MA (US); Brian M. Lucas, Marblehead, MA (US); Thomas C. Schroeder, Southborough, MA (US); Joseph A. Stabile, Worcester, MA (US)

(73) Assignee: Bose Corporation, Framingham, MA (US)

( * ) Notice: Subject to any disclaimer, the term of this patent is extended or adjusted under 35 U.S.C. 154(b) by 285 days.

(21) Appl. No.: 12/751,352

(22) Filed: Mar. 31, 2010

(65) Prior Publication Data

US 2011/0243365 A1 Oct. 6, 2011

(51) Int. Cl.

| | |
|---|---|
| ***H04R 1/20*** | (2006.01) |
| ***H04R 9/06*** | (2006.01) |
| ***H04R 11/02*** | (2006.01) |
| ***G10K 13/00*** | (2006.01) |
| *H04R 1/00* | (2006.01) |

(52) U.S. Cl. ..... 381/398; 381/418; 381/417; 181/161

(58) Field of Classification Search ..... 381/398, 381/400, 401, 402, 411, 418, 190, 395, 417; 181/161, 162, 172

See application file for complete search history.

(56) References Cited

U.S. PATENT DOCUMENTS

| | | | | |
|---|---|---|---|---|
| 1,536,116 | A | 5/1925 | Martin | |
| 1,579,864 | A | 4/1926 | Hobart | |
| 1,583,490 | A | 5/1926 | Peterson | |
| 1,614,327 | A | 1/1927 | Thomas | |
| 1,633,170 | A | 6/1927 | Fischer | |
| 1,633,366 | A | 6/1927 | Fischer | |
| 1,683,946 | A * | 9/1928 | Baldwin | 381/162 |
| 1,690,147 | A | 11/1928 | Waddell | |
| 1,693,223 | A | 11/1928 | Danziger | |
| 1,713,210 | A * | 5/1929 | Barton | 381/428 |
| 1,718,357 | A * | 6/1929 | Hutchison | 381/340 |
| 1,726,533 | A * | 9/1929 | Baldwin | 381/418 |
| 1,732,644 | A * | 10/1929 | Farrand | 381/418 |
| 1,784,517 | A | 12/1930 | Farrand | |
| 1,823,512 | A * | 9/1931 | Ringel | 181/161 |
| 1,844,605 | A | 2/1932 | Seabert | |
| 2,078,469 | A | 4/1937 | Thomas | |
| 3,062,926 | A * | 11/1962 | Ronci | 381/418 |
| 3,454,912 | A | 7/1969 | Morrison | |
| 3,460,080 | A | 8/1969 | Carbonaro | |
| 3,701,865 | A * | 10/1972 | Carlson et al. | 381/173 |

(Continued)

FOREIGN PATENT DOCUMENTS

BE 345834 A 11/1927

(Continued)

OTHER PUBLICATIONS

International Search Report and Written Opinion Dated Jun. 15, 2011 for PCT/US2011/028960.

(Continued)

*Primary Examiner* — Edgardo San Martin
(74) *Attorney, Agent, or Firm* — Bose Corporation

(57) ABSTRACT

A loudspeaker including a moving magnet motor. The moving magnet motor includes an armature comprising a magnet carrier, and a lever arm, coupling the armature and a pivot. The lever arm further couples the armature and an acoustic diaphragm to transmit motion of the armature to the acoustic diaphragm to cause the acoustic diaphragm to move. The loudspeaker described may be torque balance and moment balanced.

18 Claims, 12 Drawing Sheets

U.S. PATENT DOCUMENTS

| | | | | | |
|---|---|---|---|---|---|
| 3,777,078 | A | * | 12/1973 | Boutros-Attia et al. | 381/418 |
| 3,836,733 | A | * | 9/1974 | Cragg | 381/418 |
| 3,878,725 | A | | 4/1975 | Gaertner | |
| 3,937,904 | A | | 2/1976 | Parker | |
| 4,000,381 | A | | 12/1976 | Plice et al. | |
| 4,126,769 | A | * | 11/1978 | Broersma | 381/418 |
| 4,379,952 | A | | 4/1983 | Kaizer et al. | |
| 4,387,275 | A | | 6/1983 | Shimada et al. | |
| 4,547,631 | A | | 10/1985 | Nieuwendijk et al. | |
| 4,564,727 | A | * | 1/1986 | Danley et al. | 381/162 |
| 4,825,713 | A | | 5/1989 | Wilkey | |
| 5,216,723 | A | | 6/1993 | Froeschle et al. | |
| 5,802,189 | A | | 9/1998 | Blodget | |
| 5,809,157 | A | * | 9/1998 | Grumazescu | 381/412 |
| 5,859,731 | A | * | 1/1999 | Vezain et al. | 359/819 |
| 6,396,936 | B1 | | 5/2002 | Nevill | |
| 6,778,677 | B2 | * | 8/2004 | Coffin | 381/418 |
| 6,851,513 | B2 | | 2/2005 | Stead et al. | |
| 6,889,796 | B2 | | 5/2005 | Pocock et al. | |
| 7,174,990 | B2 | | 2/2007 | Stead et al. | |
| 7,190,803 | B2 | * | 3/2007 | van Halteren | 381/398 |
| 7,366,317 | B2 | | 4/2008 | Miller et al. | |
| 7,386,137 | B2 | * | 6/2008 | Combest | 381/182 |
| 7,412,763 | B2 | * | 8/2008 | Jiles et al. | 29/594 |
| 7,480,390 | B2 | * | 1/2009 | Tabata et al. | 381/398 |
| 7,508,953 | B2 | | 3/2009 | Hlibowicki | |
| 7,860,264 | B2 | * | 12/2010 | Jiles et al. | 381/423 |
| 8,085,955 | B2 | * | 12/2011 | Henry | 381/152 |
| 8,139,813 | B2 | | 3/2012 | Kobayashi et al. | |
| 2005/0141744 | A1 | | 6/2005 | Hlibowicki | |
| 2005/0157900 | A1 | | 7/2005 | Litovsky et al. | |
| 2005/0168111 | A1 | | 8/2005 | Bank et al. | |
| 2007/0272475 | A1 | | 11/2007 | Stead et al. | |
| 2008/0247595 | A1 | | 10/2008 | Henry | |
| 2011/0069859 | A1 | | 3/2011 | Kobayashi et al. | |
| 2011/0176703 | A1 | | 7/2011 | Horigome et al. | |
| 2011/0243365 | A1 | | 10/2011 | Carlmark et al. | |
| 2011/0243366 | A1 | | 10/2011 | Carlmark et al. | |
| 2012/0106772 | A1 | | 5/2012 | Horigome et al. | |

FOREIGN PATENT DOCUMENTS

| | | | | |
|---|---|---|---|---|
| DE | 646416 | | | 6/1937 |
| EP | 0508570 | | | 10/1992 |
| EP | 2146521 | A1 | | 1/2010 |
| FR | 572766 | | | 6/1924 |
| GB | 220990 | A | | 8/1924 |
| GB | 0248176 | A | | 3/1926 |
| GB | 0310759 | A | | 4/1929 |
| GB | 0361464 | A | | 11/1931 |
| GB | 396990 | | | 8/1933 |
| GB | 1294960 | | | 11/1972 |
| GB | 1426391 | A | | 2/1976 |
| GB | 2071961 | A | * | 9/1981 |
| JP | 58107799 | | | 6/1983 |
| JP | 08079885 | A | | 3/1996 |
| WO | 0054550 | A2 | | 9/2000 |
| WO | 2010106690 | | | 9/2010 |

OTHER PUBLICATIONS

International Search Report and Written Opinion Dated Jun. 15, 2011 PCT/US2011/028965.

C-FLEX The Bearing Solution Product Information; Frictionless, Low Hysteresis Bearing for Angular Applications; Bearing Co., Inc.

C-FLEX The Bearing Solution Technical Data; Frictionless, Low Hysteresis Bearing for Angular Applications; Bearing Co., Inc.

Olsen, Harry F.; Microphones, Acoustical Engineering, Professional Audio Journals, Inc., Philadelphia, PA 1991 pp. 270-271.

McLachlan, N. W.; Loud Speakers, Theory Performance, Testing and Design, Dover Publications, Inc., NY, NY 1960 pp. 225-226.

* cited by examiner

MOVING MAGNET LEVERED LOUDSPEAKER

BACKGROUND

This specification describes a loudspeaker employing a lever to transmit force from a motor to an acoustic diaphragm. The specification further describes a loudspeaker employing levers that is torque balance and moment balanced.

SUMMARY

In one aspect loudspeaker includes a moving magnet motor. The moving magnet motor includes an armature. The armature includes a magnet carrier; and a lever arm, coupling the armature and a pivot. The lever arm further couples the armature and an acoustic diaphragm to transmit motion of the armature to the acoustic diaphragm to cause the acoustic diaphragm to move. The lever arm may couple the armature to the acoustic diaphragm to cause the acoustic diaphragm to move in an arcuate path. The loudspeaker may further include a surround mechanically coupling the acoustic diaphragm to an acoustic enclosure and pneumatically sealing one side of the acoustic diaphragm from the other. One side of the surround may be wider than another side. The loudspeaker may further include a pivot coupling the lever arm to the acoustic diaphragm that permits the acoustic diaphragm to move in a pistonic manner. The pivot coupling the lever arm to the acoustic diaphragm may include a flexure. The pivot may coupling the lever arm to the acoustic diaphragm may be compliant in a direction perpendicular to the axis of rotation of the pivot. The pivot may include a flexure. The flexure may be an x-flexure. The x-flexure may include deflectable planar pieces having opposing edges encased in plastic. The flexure may be formed by insert molding. The flexure may have a dimension in the direction of the axis of rotation of the flexure that is greater than 50% of the length of the lever. The pivot may be compliant in a direction perpendicular to the axis of rotation of the pivot. The lever arm and the magnet carrier may be a unitary structure. The pivot point may be intermediate the armature and the acoustic diaphragm. The armature may be intermediate the pivot and the acoustic diaphragm. The moving magnet motor applying force to the lever arm in a non-contact manner.

In another aspect, a loudspeaker includes an acoustic diaphragm; a force source; and a lever arm coupling the force source and the acoustic diaphragm. The lever arm may include a part of the force source. The force source may be a moving magnet motor. The moving magnet motor may include a magnet structure. The lever arm may include the magnet structure. The loudspeaker may further include a pivot including an x-flexure.

In another aspect, a loudspeaker includes a first motor including a first armature; an acoustic diaphragm; a first lever arm, mechanically coupling the first armature and the acoustic diaphragm, the first lever arm coupled to a first pivot so that motion of the first armature causes rotation of the first lever arm about the first pivot, resulting in free body torque about the first pivot in a first direction. The loudspeaker further includes a second motor including a second armature and a second lever arm, mechanically coupling the second armature and the acoustic diaphragm, the second lever arm coupled to a second pivot so that motion of the second armature causes the second lever arm to rotate about a second pivot resulting in free body torque about the second pivot in a second direction, different than the first direction. The first motor and the second motor may be arranged in a manner such that the total free body torque resulting from the rotation of the first lever arm and the rotation of the second lever arm is less than the free body torque resulting from the rotation of the first lever arm and the free body torque resulting from the rotation of the second arm singly. The first lever arm may include a first lever arm first section, coupling the first pivot and the first armature; a first lever arm second section coupling the first pivot and the acoustic diaphragm. The mass distribution of the first lever arm first section and of the first armature has a first moment about the first pivot. The mass distribution of the first lever arm second section and of the acoustic diaphragm has a second moment about the first pivot. The lesser of the magnitude of the first moment and the magnitude of the second moment may be at least ⅔ of the greater of the magnitude of the first moment and the magnitude of the second moment. The magnitude of the second moment may further include the mass of the air moved by the diaphragm. The lesser of the magnitude of the first moment and the magnitude of the second moment may be at least 90% of the greater of the magnitude of the first moment and the magnitude of the second moment. The second lever arm may include a second lever arm first section, coupling the second pivot and the second armature and a second lever arm second section coupling the second pivot and the acoustic diaphragm. The mass distribution of the second lever arm first section and of the second armature has a third moment about the second pivot. The mass distribution of the second lever arm second section and of the acoustic diaphragm has a fourth moment about the second pivot. The lesser of the magnitude of the third moment and the magnitude of the fourth moment may be at least ⅔ of the greater of the magnitude of the first moment and the magnitude of the second moment. The first armature may include a magnet structure of a moving magnet motor. The first pivot may include an x-flexure. The first lever arm first section may be coupled to the first diaphragm in a manner that permits pistonic motion of the first diaphragm. The first lever arm first section may be coupled to the first diaphragm by an x-flexure. The oscillation of the diaphragm may be in a space between two parallel planes. A portion of the first armature may be positioned between the two planes.

In another aspect, a loudspeaker includes a plurality of motors each including a corresponding armature and a corresponding lever arm, mechanically coupling each armature and the acoustic diaphragm. Each of the corresponding lever arms is coupled to a corresponding pivot so that motion of each of the corresponding armatures causes each of the corresponding lever arms to rotate about the corresponding pivot, causing torque in a direction different than the first direction. The plurality of motors are positioned and dimensioned in a manner such that the total free body torque resulting from the rotation of the plurality of lever arms is less than the free body torque resulting from the rotation of the first lever arm or any one of the plurality of the lever arms singly. Each of the corresponding lever arms may include a lever arm first section, coupling the corresponding pivot and the corresponding armature and a lever arm second section coupling the corresponding pivot and the acoustic diaphragm. The mass distribution of the corresponding lever arm first section and of the corresponding armature has a corresponding first moment. The mass distribution of the corresponding lever arm second section and of the acoustic diaphragm may have a corresponding second moment. The lesser of the corresponding first moment and the corresponding second moment may be at least ⅔ of the greater of the corresponding first moment and the corresponding second moment. The lesser of the corresponding first moment and the corresponding second moment may be at least 90% of the greater of the corresponding first moment and the corresponding second moment.

In another aspect, a loudspeaker includes a motor includes an armature; an acoustic diaphragm; a lever arm, mechanically coupling the armature and the acoustic diaphragm. The lever arm is coupled to a pivot so that motion of the armature causes oscillation of the lever arm about the pivot. The lever arm may include a first section, coupling the pivot and the armature. The lever arm further includes a second section coupling the first pivot and the acoustic diaphragm. The mass distributions of the first section and the armature are characterized by a first moment about the pivot. The mass distributions of the second section and the acoustic diaphragm are characterized by a second moment about the pivot. The lesser of the magnitude of the first moment and the magnitude of the second moment is at least ⅔ of the larger of the magnitude of the first moment and the magnitude of the second moment. The lesser of the magnitude of the first moment and the magnitude of the second moment may be at least 90% of the larger of the magnitude of the first moment and the magnitude of the second moment Other features, objects, and advantages will become apparent from the following detailed description, when read in connection with the following drawing, in which:

DETAILED DESCRIPTION

Figure 1:
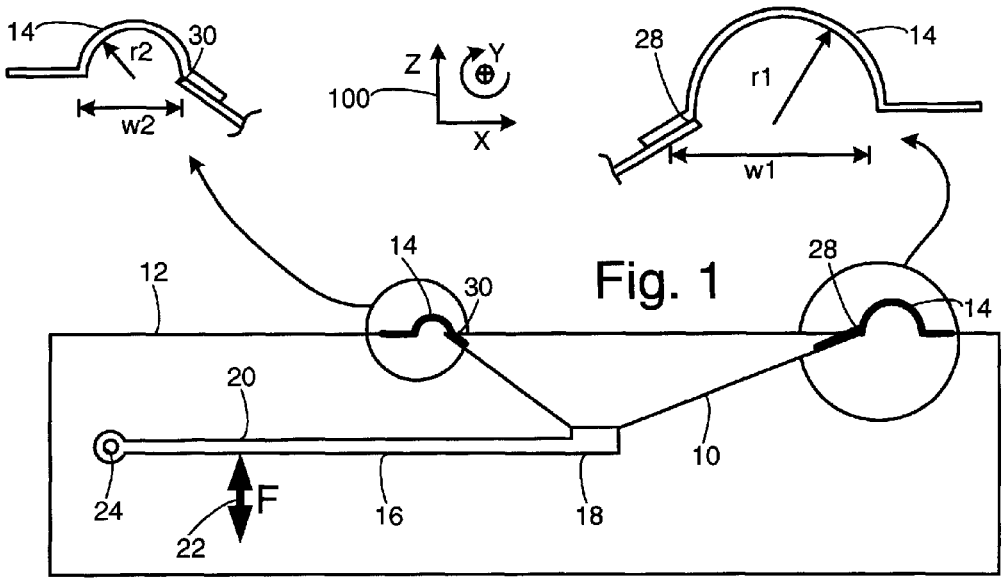
FIG. 1 is a diagrammatic cross-sectional view of a loudspeaker.

FIG. 1 shows a diagrammatic cross-sectional view of a loudspeaker. For purposes of illustration, some elements of the loudspeaker are omitted from this view, and some dimensions are exaggerated. A diaphragm, 10 in this instance a cone type speaker diaphragm is mounted to an acoustic enclosure 12 by a surround 14. The loudspeaker includes a lever arm 16 that is mechanically connected at one point 18 along the lever arm to the diaphragm and at another point 20 along the lever arm to an oscillatory force source, represented in this figure by the letter F and a two headed arrow 22. At a pivot point 24, the lever arm is pivotally connected to a stationary object, such as the enclosure 12 or the frame of the loudspeaker, which is rigidly coupled to the enclosure, in a manner so that the lever arm extends radially from the pivot point. Coordinate system 100 indicates the orientation of the components in the figure. So, for example in FIG. 1, the lever 16 extends in the X-direction, the force is applied in the Z-direction when the lever arm is at a neutral position, and the pivot 24 rotates about the Y-axis.

The lever arm 16 may be straight as shown, or may be bent. The joint at the pivot point 24 may be a hinge arrangement as shown, but in other implementations may be a bearing, or a torsion bar, or a flexure arrangement, as will be described below, or some other type of pivot. In conventional loudspeakers, the surround 14 functions as both a pneumatic seal and as a suspension element. In the loudspeaker of FIG. 1, the surround functions principally as a pneumatic seal, and the requirement to function as a suspension element is minimal, because centering are provided by other elements of the loudspeaker, as will be described below.

Figure 2A:
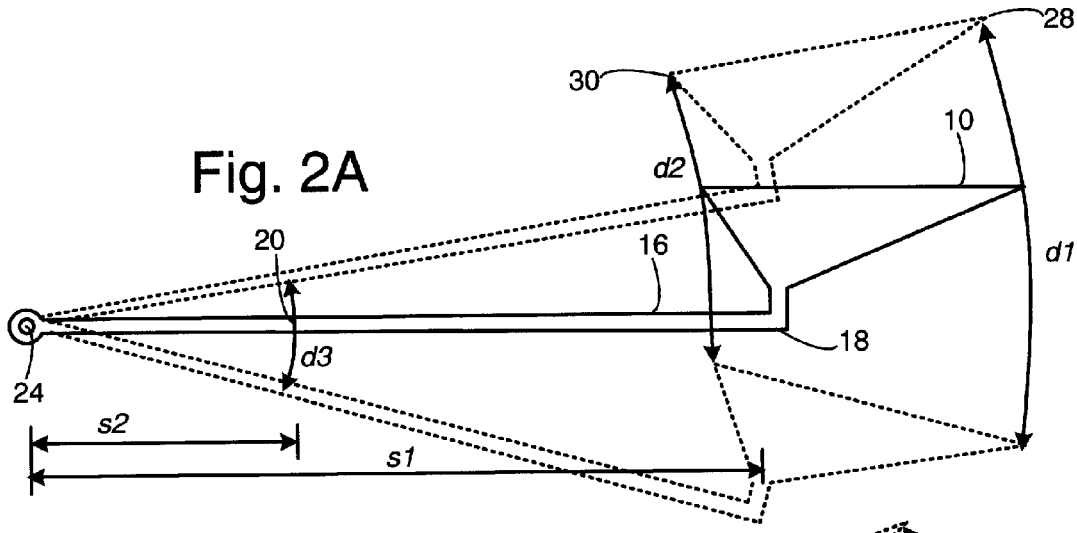
FIGS. 2A-2C are diagrammatic cross-sectional views of loudspeakers.

Referring now to FIG. 2A, the pivot point 24, the lever arm 16, and the diaphragm 10 are configured as a third class lever. Using lever terminology, point 20 at which the force is applied is the lever effort, and the effort is intermediate the pivot point 24, which represents the lever fulcrum, and the point of attachment to the diaphragm 10, which represents the lever resistance. In the arrangement of FIG. 2A, when the oscillatory force is applied to the lever arm, the diaphragm 10 and the force application point 20 both move in an arcuate path, and the distance moved by the diaphragm is greater than the distance moved by the force application point. The edge 28 of the diaphragm farthest from the pivot point 24 moves a distance d1 that is greater than the distance d2 moved by the edge 30 nearest the pivot point. Both d1 and d2 are greater than the distance d3 moved by the force application point 20. With a third class lever configuration, the distance moved by the diaphragm 10 is greater than the distance moved by the point 20 at which the force is applied. The amount by which the distance is greater is determined by the relative lengths of s1 (the distance from the diaphragm attachment point to the pivot) and s2 (the distance from the force application point to the pivot).

Figure 2B:
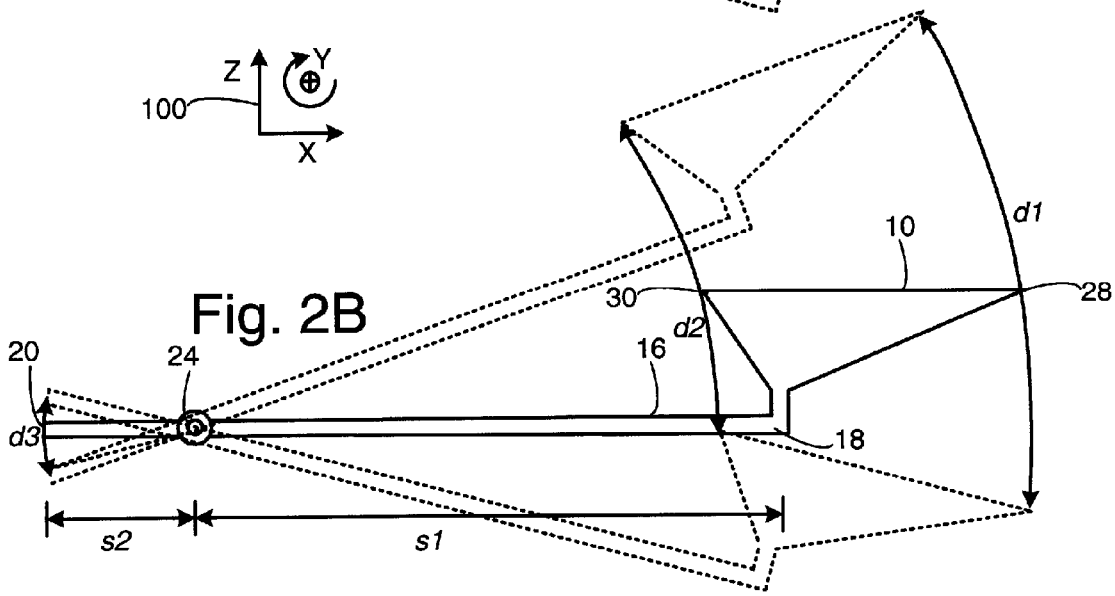

FIG. 2B shows the pivot point 24, the lever arm 16, and the diaphragm 10 configured as a first class lever. In the configuration of FIG. 2B, the pivot point 24 (the lever fulcrum) is intermediate the force application point 20 (the lever effort) and the diaphragm attachment point 18 (the lever resistance). In the arrangement of FIG. 2B, when the oscillatory force is applied to the lever arm, the force application point 20 and the diaphragm 10 both move in an arcuate path. With a first class lever configuration, if distance s1, from the diaphragm attachment point 18 to the pivot point 24 is greater than the distance s2 from the pivot point 24 to the force application point 20, the distance moved by the diaphragm is greater than the distance d3 moved by the force application point 20. If the distance s1 is less than the distance s2, as in FIG. 2B, the distance moved by the diaphragm is less than the distance moved by the force application point. In either case, the edge 28 of the diaphragm farthest from the pivot point 24 moves a distance d1 that is greater than the distance d2 moved by the edge 30 nearest the pivot point.

Figure 2C:
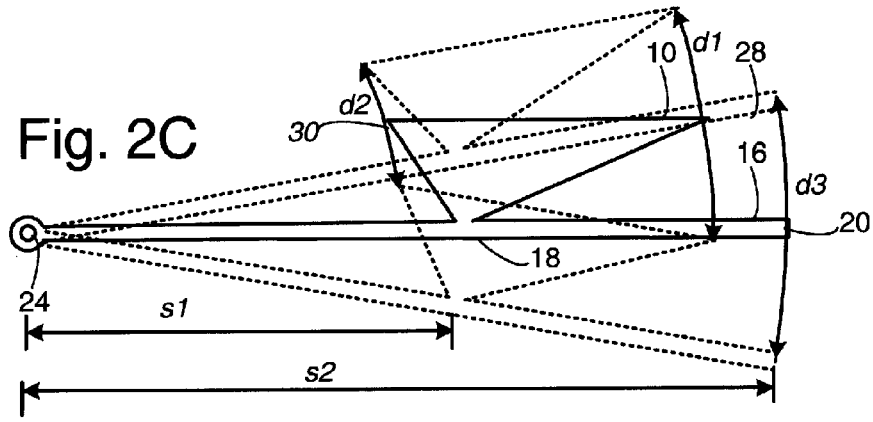

FIG. 2C shows the pivot point 24, the lever arm 16, and the diaphragm 10 configured as a second class lever. In the arrangement of FIG. 2C, when the oscillatory force is applied to the lever arm at point 20, the diaphragm 10 and the force application point 20 both move in an arcuate path, and the distance moved by the diaphragm is less than the distance moved by the force application point. The edge 28 of the diaphragm farthest from the pivot point 24 moves a distance d1 that is greater than the distance d2 moved by the edge 30 nearest the pivot point. Both d1 and d2 are less than the distance d3 moved by the force application point 20. With a second class lever configuration, the distance moved by the diaphragm 10 is less than the distance moved by the point 20 at which the force is applied. The amount by which the distance is less is determined by the relative lengths of s1 (the distance from the diaphragm attachment point to the pivot) and s2 (the distance from the force application point to the pivot).

In loudspeakers, it is frequently desirable to increase the excursion of the diaphragm, so the most common configurations will be the third class lever of FIG. 2A or a first class lever of FIG. 2B with the distance s1 greater than distance s2. For convenience, the remainder of the examples with be shown with the configuration of FIG. 2A or the configuration of FIG. 2B with s1>s2, it being understood that the principles described herein can be applied to the configuration of FIG. 2C other configurations.

Figure 3:
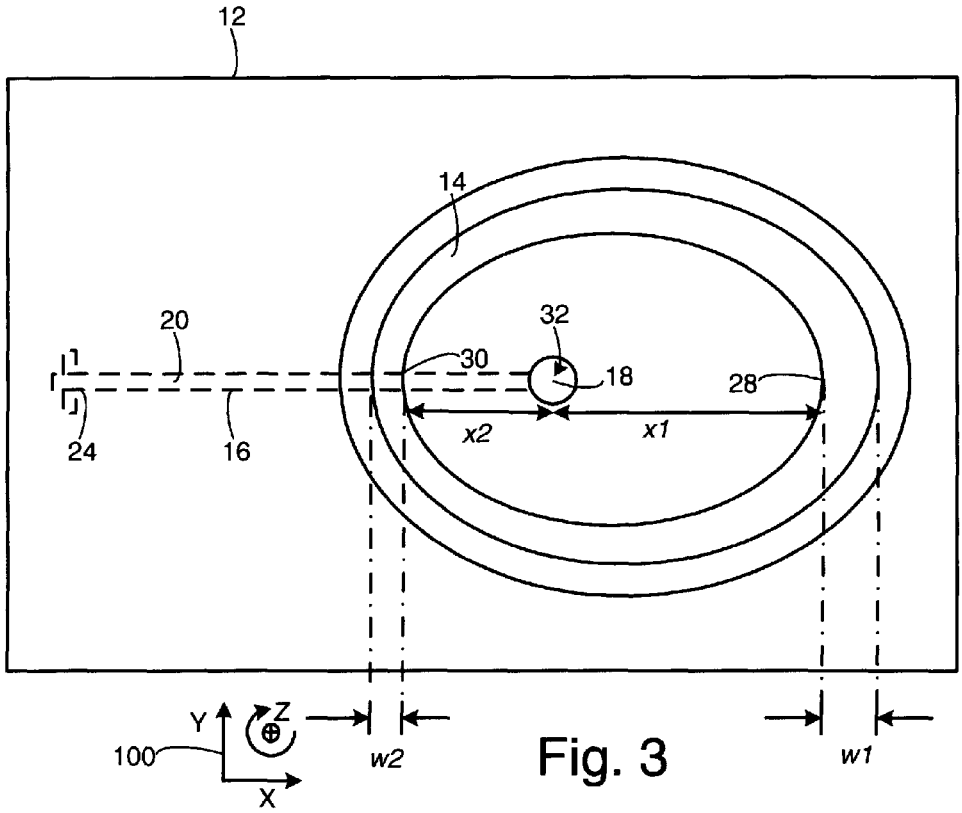
FIG. 3 is a diagrammatic top plan view of a loudspeaker.

FIG. 3 is a top plan view of the loudspeaker of FIG. 1. As noted in the discussion of FIGS. 2A and 2B, the distance moved by point 28 on the diaphragm farthest from the pivot point 24 is greater than the point 30 on the diaphragm closest to the pivot point 24. The surround 14 is arranged to permit the greater distance moved by point 28 than by point 30. For example, in the loudspeaker of FIG. 3, the surround 14 is a half roll surround dimensioned so that the radius of curvature r1 of the surround and the width w1 of the surround are greater at point 28 than the radius of curvature r2 and the width w2 of the surround at point 30. This arrangement permits point 28 to move a greater distance than point 30 during operation of the loudspeaker, as shown in FIGS. 2A and 2B. For other surround topologies, for example surrounds with oval cross-sections or with multiple rolls, other asymmetries may permit greater movement of one side of the diaphragm than the other side. FIG. 3 also shows that the lever arm 16 is attached to the diaphragm along a circular surface 32, so that the point of attachment 18 is taken as the center of circular surface 32. FIGS. 1 and 3 also show that the diaphragm may be asymmetric, so for example, elliptical with the distance x1 from diaphragm attachment point 18 to point 28 on the diaphragm is greater than the distance x2 from the diaphragm attachment point 18 to point 30 on the diaphragm. In other implementations, the diaphragm may be asymmetric with x1=x2 or the diaphragm may be symmetric or asymmetric or may be some regular or irregular non-elliptical shape.

Figure 4:
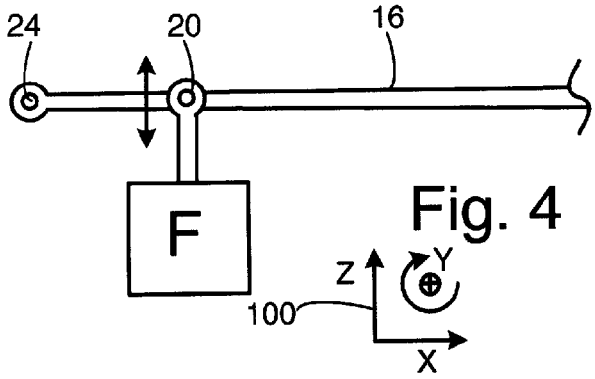
FIG. 4 is a diagrammatic view of a force source and a linear motor actuator.

The force, represented by "F" in FIG. 1 can be applied mechanically, for example by connecting the lever arm 16 to the armature of a linear actuator, possibly through some linkage arrangement as shown in FIG. 4.

Figure 5A:
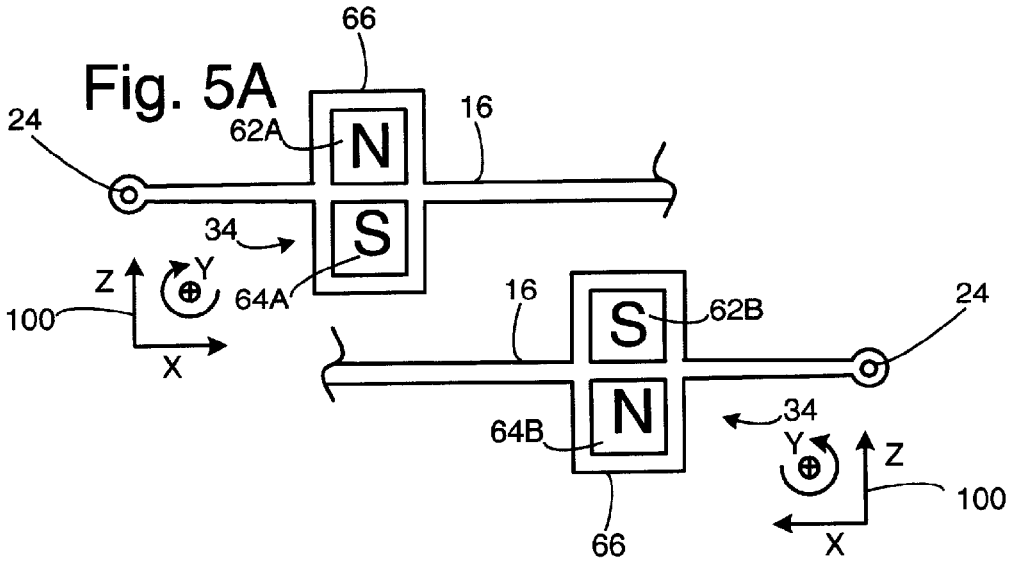
FIGS. 5A and 5B are views of arrangements for applying force to a lever arm.
Figure 5B:
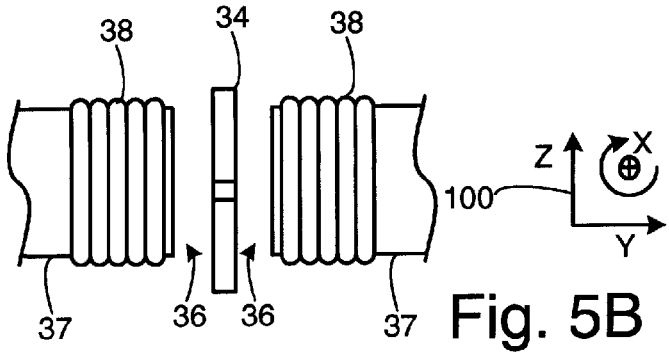

Another arrangement for applying the force to the lever arm is shown in FIGS. 5A and 5B. FIG. 5A shows two opposite sides of a lever arm 16 that includes a substantially planar magnet structure 34 with north and south poles denoted by "N" and "S" respectively. The magnet structure may include a magnet carrier and one or more permanent magnets. The magnet carrier and the lever may both be part of one unitary structure. An upper portion 62A of a first face of the magnet structure is magnetized as north pole and the lower portion 64A of the first face of the magnet structure is magnetized as a south pole. An upper portion 62B of the second face of the magnet structure is magnetized as a south pole and the lower portion 64B of the second face of the magnet structure is magnetized as a north pole. The magnet structure may include a magnet carrier 66 enclosing a single magnet, magnetized in the manner shown, or two separate magnets placed in the carrier so that the poles are arranged as shown. The lever arm is positioned so that magnet structure 34 is in a gap 36 in a core 37 of low reluctance magnetic material around which a coil 38 is wound. Alternating electrical current is passed through the coils so that the combination of the magnetic structure 34, the core 37, and the coil 38 form a moving magnet motor, for example, similar to the moving magnet motor described in U.S. Pat. No. 5,216,723, incorporated herein by reference. In this arrangement, the force results from the interaction of the magnetic field in the gap due to current flowing in the coils and the magnetic fields of magnet structure 34, so the force is applied to the lever in a non-contact manner.

Moving magnet motors are subject to "crashing force" resulting from magnetic attraction between the core 37 and the magnet structure 34. The magnetic forces are substantially in the Y direction. The magnetic attraction force varies as a function of distance between the magnet structure and core; the closer the magnet structure is to the core, the stronger the crashing force. It may be convenient to think of the structure as requiring a "crashing stiffness" that takes into account the variation in attraction force with distance. The crashing stiffness may appear as a "negative stiffness". The pivot 24 and lever arm 16 must provide a great deal of stiffness (sufficient to resist the maximum crashing force) relative to displacement in the Y-direction. The crashing stiffness, in this configuration, stiffness of the suspension in the Y-direction is particularly important because it is desirable for the gap 36 to be as small as possible. A smaller gap 36 implies a smaller distance between the surface of the magnet structure 34 and the motor core 37. Less relative motion between the magnetic structure 34 and the core 37 can be tolerated when the gap dimensions are reduced. High Y-axis stiffness of the pivot 24 is required to ensure there is little relative motion between the magnetic structure 34 and the core 37 in the Y-axis dimension Magnetic forces tend to urge the magnet structure to be centered in the gap in the Z-direction in the position shown in FIG. 5B. Therefore, the pivot 24 does not need stiffness relative to rotation about the Y-axis to provide centering force and the centering force requirements of the surround 14 are reduced. The surround 14 and the pivot 24 can be configured so that the surround 14 and the pivot 24 only need to maintain the magnet structure in the gap, while the centering force within the gap is provided by magnetic forces. However, in practical implementations, it is desirable for the pivot 24 (and/or the surround 14) to provide at least some additional centering force, as the centering force provided by pivot 24 (and/or surround 14) will typically be more linear than the magnetic centering stiffness.

Some compliance in the X-direction can be tolerated, because the magnet structure 34 may move in the X-direction and still largely remain in the gap 36. Relative motion in the X-axis direction does not give rise to mechanical interference between components in the motor structure, as would be the case for typical axi-symetric motor designs (such as moving coil motors). Displacement in the X-direction does not cause damage to other components, such as the diaphragm 10, the coil 38 or the core 37. Compliance in the X-direction may actually be advantageous in some circumstances, as will be described below.

Figure 6:
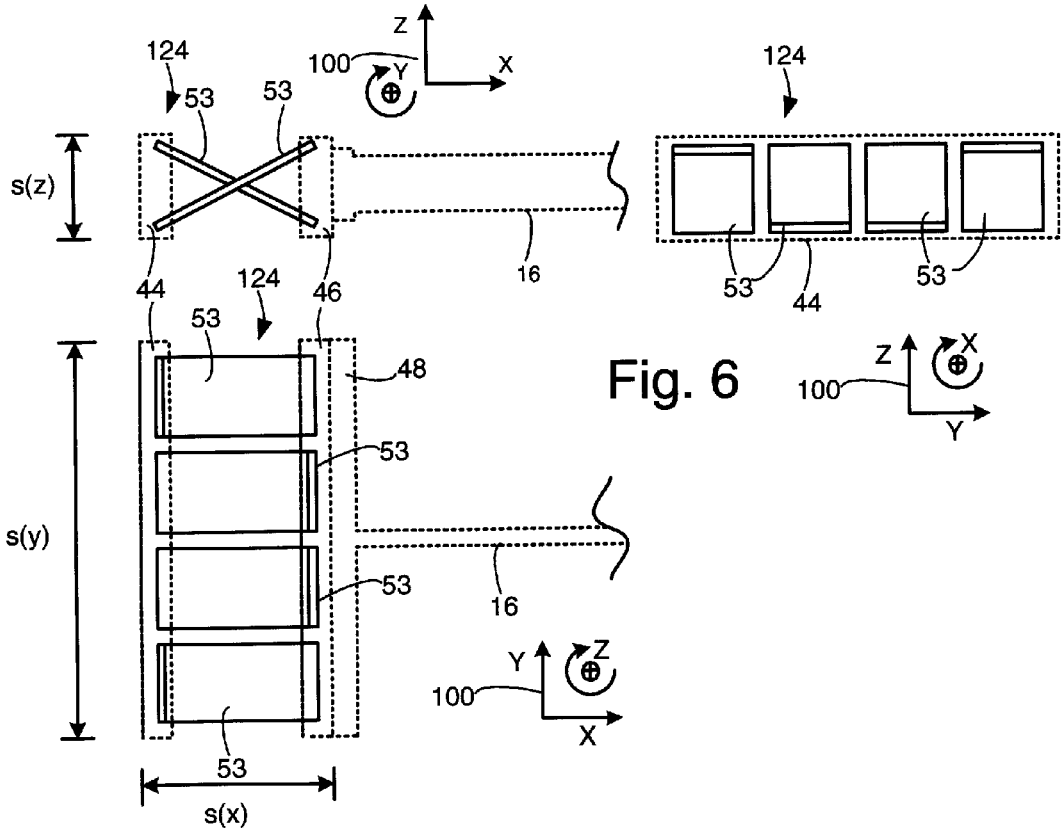
FIG. 6 shows three plan views of a flexure pivot.

FIG. 6 shows three plan views of a flexure pivot 124 that provides great stiffness in the Y-direction and about the Z-axis and X-axis. The flexure pivot 124 includes a plurality, in this case four, of sections 53 of a flexure material, such as high fatigue strength stainless steel, approximately 18 mm×20 mm by 0.13 mm thick. For purpose of illustration, the thickness dimension is greatly exaggerated in FIG. 6. The sections may be substantially planar. The flexure material is resistant to tension or compression deformation in the plane of the section, but deforms or flexes in response to force normal to the plane of the section. The sections are positioned in at least two planes, which are inclined relative to each other so that the planes intersect along a line and so that, when viewed along the Y-axis, the sections form an "X" configuration. The ends of the sections are encased in plastic blocks 44, 46, which hold the sections in place. The flexure pivot 124 is mechanically attached to the lever arm 16. The flexure pivot 124 has a relatively wide "footprint" along the Z-axis. For example, the dimension $s_z$ of the flexure pivot 124 along the Z-axis may be greater than the thickness (that is, the dimension of the lever arm in the Y-direction) of the lever 16 at its thickest point. In one implementation, the thickness of the lever is 5 mm and $s_z$ is 6.5 mm or about 130% of the thickness of the lever at its thickest point. The flexure pivot 124 has very wide footprint along the Y-axis. For example, the dimension $s_y$ along the Y-axis may be greater than 50% of the length of the lever 16 and more than 10 times the thickness of the lever arm. In one implementation, the length of the lever is 84 mm and $s_y$ is 75 mm or 89% of the length of the lever, the thickness of the lever is 5 mm so $s_y$ is 15 times the thickness of the lever arm.

The very wide footprint along the Y-axis (dimension $s_y$ of FIG. 6) and the wide footprint along the Z-axis (dimension $s_z$ of FIG. 6) of the flexure pivot 124 with an attachment surface for the lever 16 that includes a flange or extension 48 that has a corresponding footprint along the Y-axis and the Z-axis permit the use of several mechanical fasteners, for example screws, rivets, or the like, and also provide ample surface for adhesives and to provide resistance to displacement in the Y-direction. Therefore, there is very great stiffness (greater than the crashing stiffness, and preferably multiples, for example 10, and more preferably many multiples, for example 50 or even more that 70, times the crashing stiffness) . In one implementation the moving magnet motor has a crashing stiffness of about 120 Nt/mm and the pivot stiffness in the Y-direction is about 8600 Nt/mm) along the Y-axis and about the X-axis and about the Z-axis.

Since the footprint of the flexure along the X-axis is relatively wide, and since the sections of flexure material are deflected by force normal to the plane of the sections of flexure material, the flexure pivot 124 provides low stiffness, for example 0.133 Nt/degree or 7.6 Nt/radian, to rotation about the Y-axis. Additionally there is some compliance in the X-direction, and the pivot point may move in the X-direction, which will be discussed below.

The flexure pivot 124 of FIG. 6 may be formed by insert molding to eliminate the need for fasteners or adhesives. The flexure sections 53 can be placed in an injection molding tool and the plastic blocks 44 and 46 molded to encapsulate the flexure sections 53. Additionally, some or all of the magnet structure 34, the flexure 124, and the lever arm 16 may be insert molded in a single insert molding operation.

Figure 7:
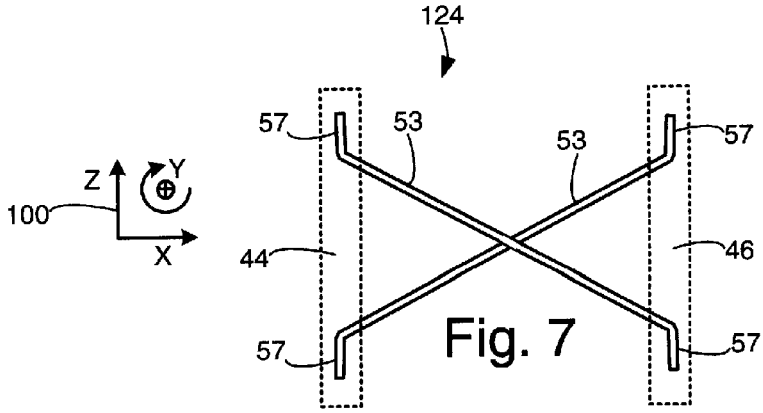
FIG. 7 is a view of an embodiment of the flexure pivot of FIG. 6.

The sections may be substantially planar or may be bent at the ends or have a flange 57 attached at the ends to increase resistance to lateral pull-out from the plastic blocks 44, 46 as shown in FIG. 7.

Figure 8A:
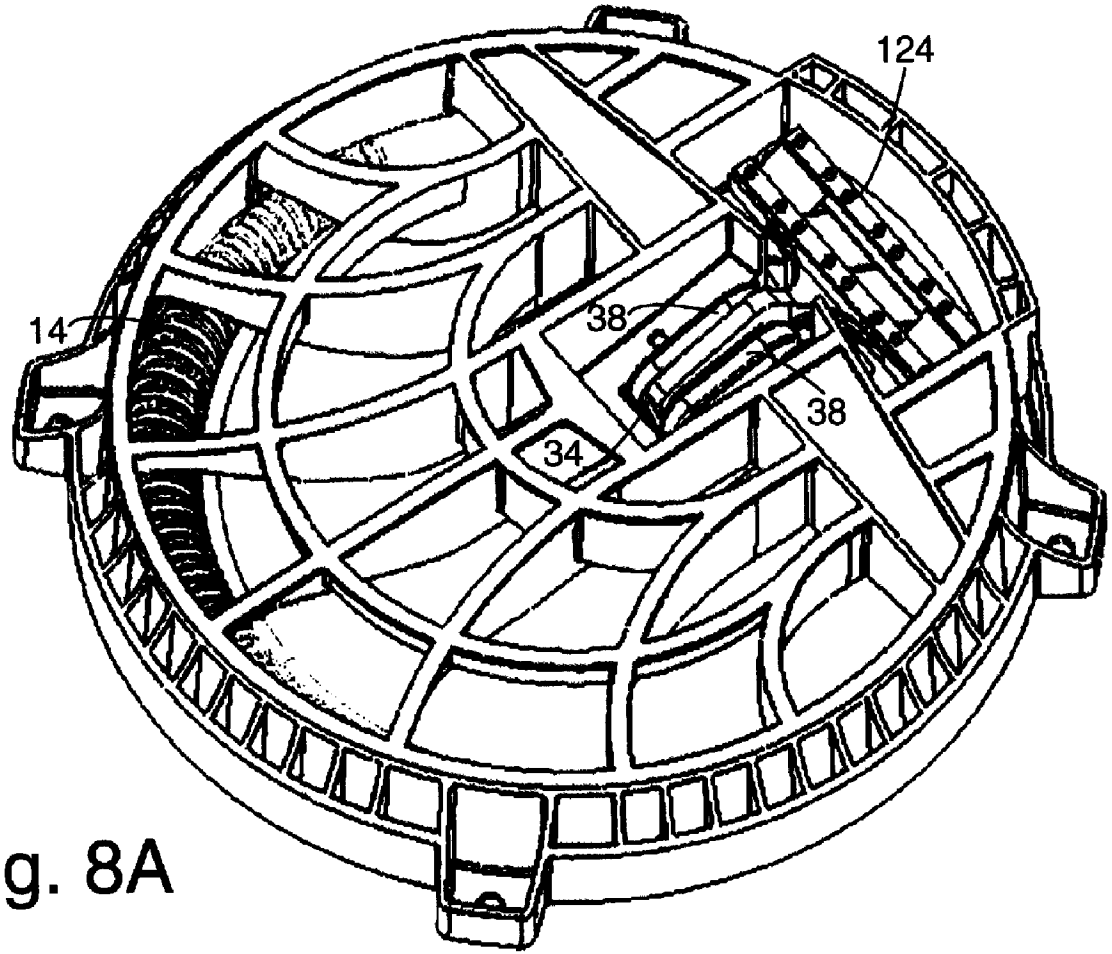
FIGS. 8A and 8B are an isometric view and a cross-sectional view, respectively, of a loudspeaker configured as a third class lever.
Figure 8B:
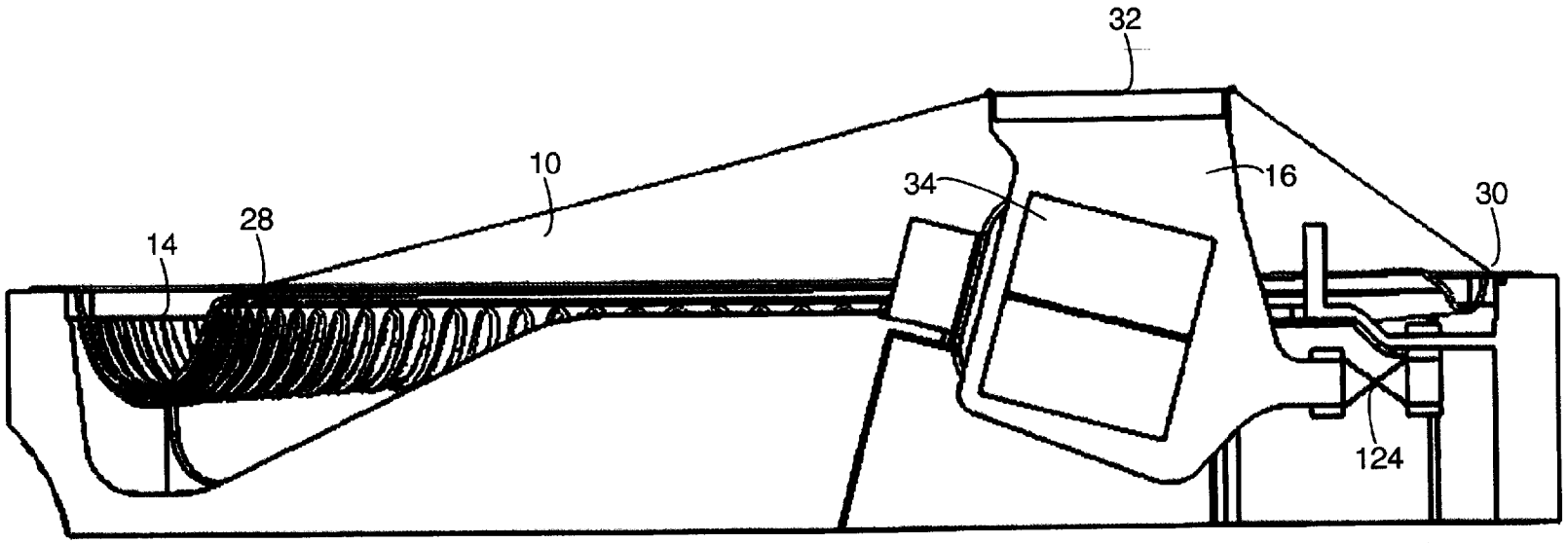

FIG. 8 shows an implementation of the a loudspeaker configured as a third class lever, as shown in FIG. 2A, and using a flexure pivot 124 as shown in FIG. 6. Reference numbers in FIG. 8 refer to correspondingly numbered elements in previous figures. The implementation of FIG. 8 includes a flexure pivot that is mechanically fastened, as opposed to assembled by insert molding.

Figure 9A:
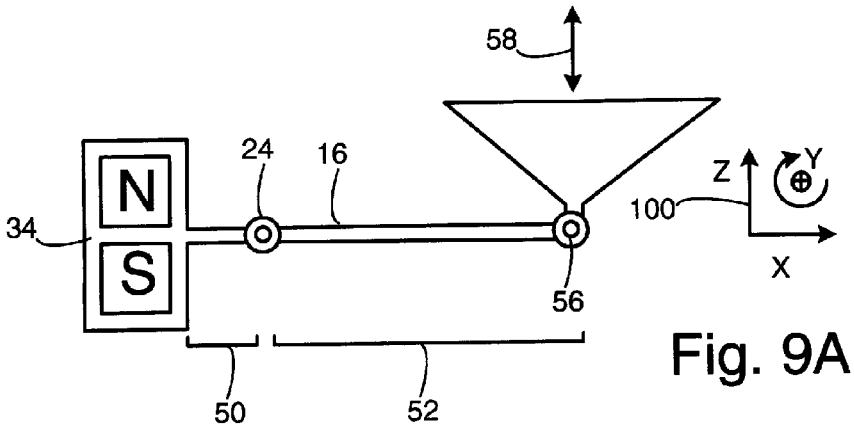
FIG. 9A is an assembly including a lever, a magnet structure, and a diaphragm.
Figure 9B:
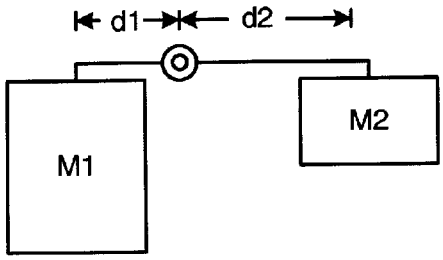
FIG. 9B is a diagram of the mass distribution of the assembly of FIG. 9A.

FIG. 9A shows an assembly including the lever 16, a magnet structure 34, and a diaphragm 10 of another implementation. The assembly of FIG. 9A is configured as a first class lever, as in FIG. 2B. The masses of the elements of the assembly of FIG. 9A and the distribution of mass within the elements of FIG. 9A are configured so that it is moment balanced about the pivot point. As illustrated in FIG. 9B, if the mass of the magnet structure 34 and the portion of the lever arm that is on the same side of the pivot 24 as the magnet structure have a combined mass M1 and a center of gravity that is distance d1 from the pivot, and the mass of the diaphragm 10 (and if desired, the mass of air moving with the diaphragm) and the portion of the lever arm that is on the same side of the pivot as the diaphragm 10 have a combined mass M2 and a center of gravity this is distance d2 from the pivot, then the magnitude of M1×d1=the magnitude of M2×d2. For convenience, hereafter the magnitude of M1×d1 will be referred to as M1×d1 and the magnitude of M2×d2 will be referred to as M2×d2. Additionally, the center of gravity of the combined masses M1 and M2 is at the pivot point. Configuring elements and configuring the mass distribution within elements so the moment about a point is balanced it typically done by computer analysis, for example, by computer aided design (CAD) software or can be done empirically, or for simple geometries, calculated by hand.

If the moments are not precisely equal, perceptible, beneficial effect can still be obtained if the lesser of M1×D1 and M2×D2 is greater than ⅔ of the larger; however, it is preferable that the lesser of M1×D1 is at least 0.9 times the larger.

In operation, a moment balanced arrangement results in less mechanical vibration being transmitted to structure to which the loudspeaker motor is rigidly coupled. Since there is less mechanical vibration transmitted to rigidly coupled structure, a loudspeaker employing the assembly of FIG. 9A requires less vibration damping and less stiffening of the structure that is mechanically coupled to the loudspeaker than loudspeakers that are not moment balanced. The magnet structure 34 is typically heavier than the cone 10, so in order to balance the moment, the portion 52 of the lever 16 on the same side as the cone 10 is longer that the portion 50 of the lever 16 on the same side as the magnet structure. Therefore, the cone moves farther than the magnet structure, which is typically advantageous.

The moving magnet architecture makes it simpler to achieve torque cancellation (which will be described below) and moment balance. Because the magnets are relatively small and dense, repositioning the magnet structure to achieve torque balance and moment balance is easily done. With, for example, moving coil motors, the bobbin and coil assembly are not small or dense or easily repositioned. However, the moment balancing advantageously be applied to moving coil motors, particulary if there is a large amount of conductor (typically copper) in the coil.

It may be desired for lever 16 to be coupled to cone 10 by a pivot 56 that permits cone 10 to move pistonically, as indicated by arrow 58, and not in an arcuate path as shown in FIGS. 2A-2C. Permitting pistonic motion of cone 10 requires allowing the distance between the pivot 24 and the cone 10 to vary with excursion of the cone 10 in the Z-axis. The lengthening may be accomplished by a complicated linkage arrangement, or by providing some system compliance between the pivot 24 and the cone 10, for example in one or both of pivots 24 or 56. As stated above, the flexure pivot 124 of FIG. 6 is compliant in the X-direction, and therefore may be advantageously implemented for the pivot 24 or 56 or both. In one implementation the pivot 56 has a structure similar to pivot 124 of FIG. 6, but with two flexure sections 53 instead of four.

The lever arm 16, the pivot 24, and the pivot 56 (including the joint between the pivot 56 and the diaphragm 10) form a mechanical subsystem with a resonance. By altering characteristics of one or more of the lever arm 16, the pivot 24, and the pivot 56, the mechanical subsystem may be tuned to have a resonance that increases the bandwidth of the loudspeaker. For example, if the loudspeaker has a roll-off at a known frequency, the mechanical subsystem may be tuned to have a resonance in the direction of the motion of the diaphragm 10 (in this example, the Z-direction) at a frequency near the known frequency, effectively increasing the bandwidth of the loudspeaker. Though the characteristics of any of the lever arm 16, the pivot 24, or the pivot 56 can be set to have a resonance at a given frequency, it is typically most convenient to set the characteristics of the pivot 56 between the lever 16 and the diaphragm 10 to obtain the desired resonance. Preferably, the compliance in the Z axis direction of the pivot 56 would be chosen to resonate with the moving mass of the diaphragm 10 at a desired resonance frequency. Additional characteristics may be varied to affect the Q of the resonance by introducing damping. For example, the material chosen to provide compliance for pivot 56 may also be chosen to have desired internal loss characteristics. Alternatively, the attachment of pivot 56 to either or both of the level arm 16 or diaphragm 10 may incorporate a damping element such as a soft adhesive. Altering characteristics of one or more components of the mechanical subsystem to achieve a resonance at a desired frequency may be done by computer analysis, for example structural finite element analysis (FEA).

Figure 10A:
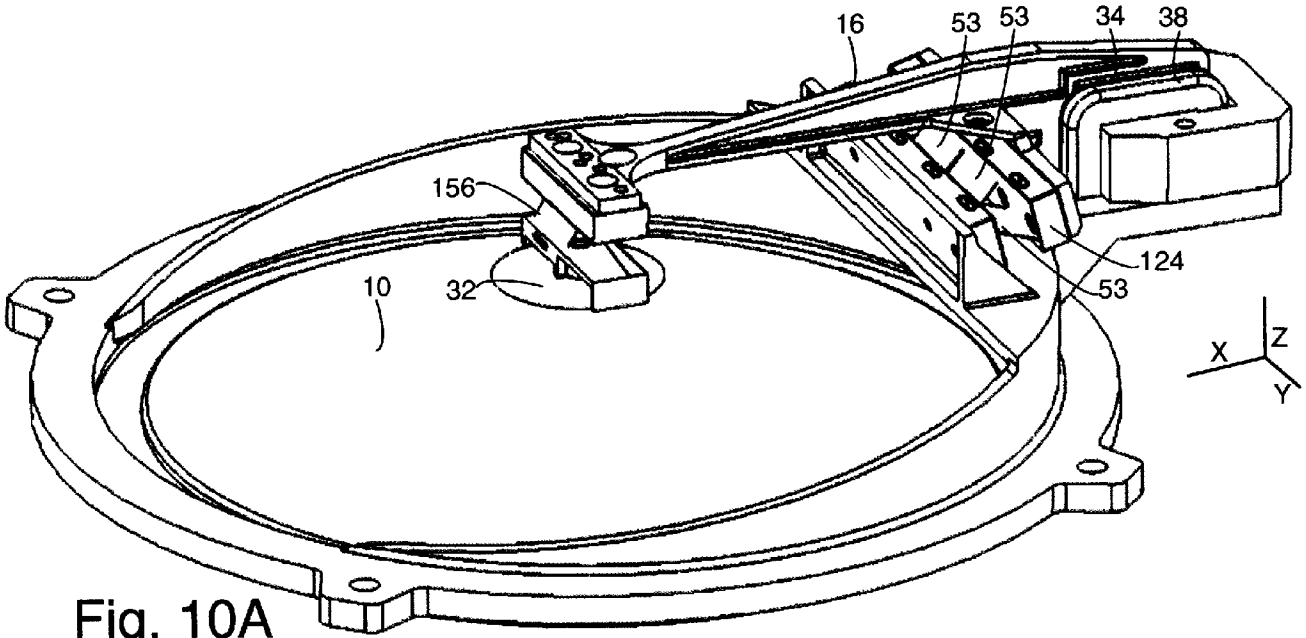
FIGS. 10A and 10B are views of an implementation of the assembly of FIG. 9A.
Figure 10B:
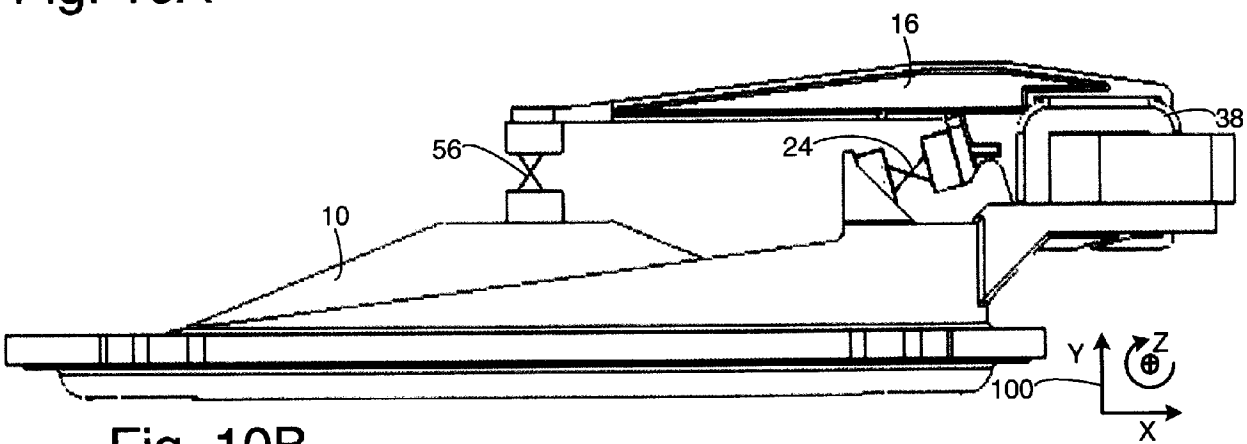

FIGS. 10A and 10B are a plan view and an isometric view, respectively, of an implementation of the loudspeaker including the assembly of FIG. 9A and including a flexure pivot 156 as the pivot 56 of FIG. 9A. The flexure pivot 156 includes two sections of flexure material. Reference numbers in FIGS. 10A and 10B refer to correspondingly numbered elements in previous figures.

Figure 11:
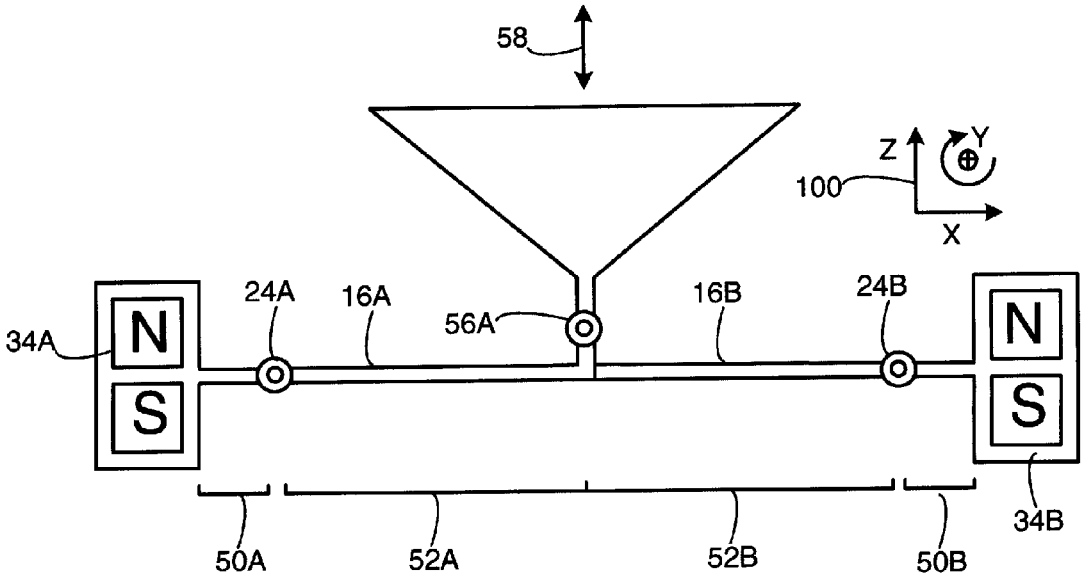
FIG. 11 is a diagrammatic view of a moment balance and torque balanced structure.

FIG. 11 shows an assembly that is both moment balanced and torque balanced. A first subassembly includes magnet structure 34A, lever 16A with portions 50A and 52A on either side of pivot 24A. Lever 16A is connected to cone 10 by a pivot 56A that permits cone 10 to move pistonically, as indicated by arrow 58. The first subassembly is moment balanced, as in the implementation of FIG. 9. FIG. 11 also includes a second subassembly that includes magnet structure 34B, lever 16B with portions 50B and 52B on either side of pivot 24B. Lever 16B is connected to cone 10 by a pivot 56B (obscured in this view) that permits cone 10 to move pistonically, as indicated by arrow 58. The second subassembly is also moment balanced, as in the implementation of FIG. 9. The two subassemblies are configured so that the Y-axis free body torques of the two subassemblies are in opposite directions about the Y-axis and the free body torques offset. If the torques are equal and opposite the total free body torque (that is, assuming that the components are rigid) may be zero. Even if the free body torques are not equal, or the free body torques are substantially but not precisely opposite, there is some torque cancellation and the total free body torque of the system is less than either free body torque singly The assembly of FIG. 11 is both moment balanced and torque balanced, so there is even less mechanical vibration than with the assembly of FIG. 9.

Figure 12A:
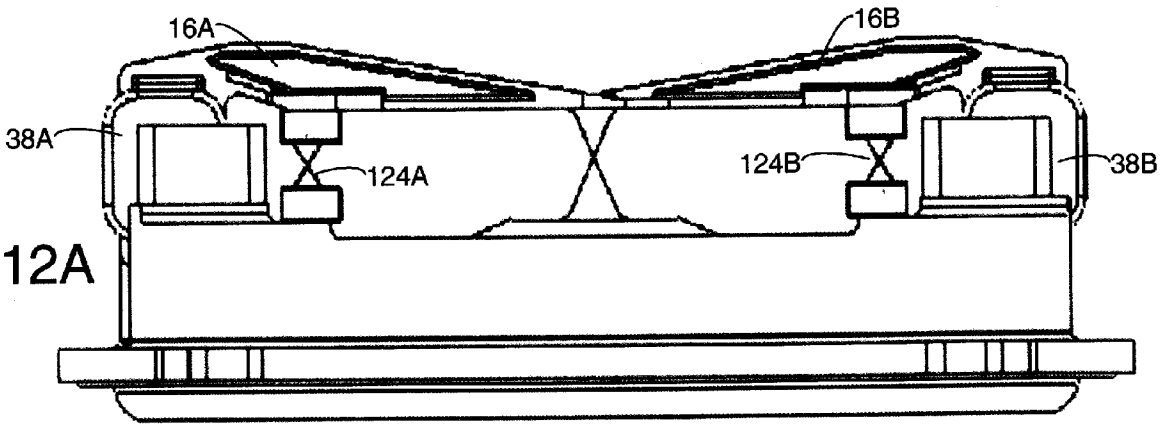
FIGS. 12A and 12B are views of an implementation of the structure of FIG. 11.
Figure 12B:
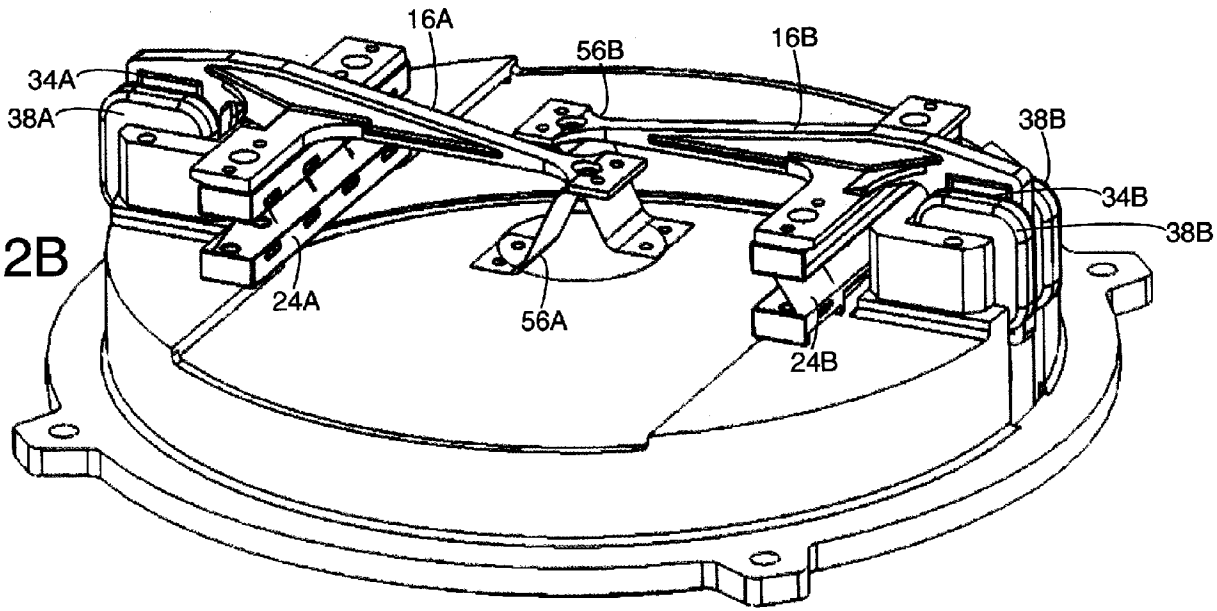

FIGS. 12A and 12B are a plan view and an isometric view, respectively, of an actual implementation of the a loudspeaker including the assembly of FIG. 11. Reference numbers in FIGS. 12A and 12B refer to correspondingly numbered elements in previous figures.

Figure 13:
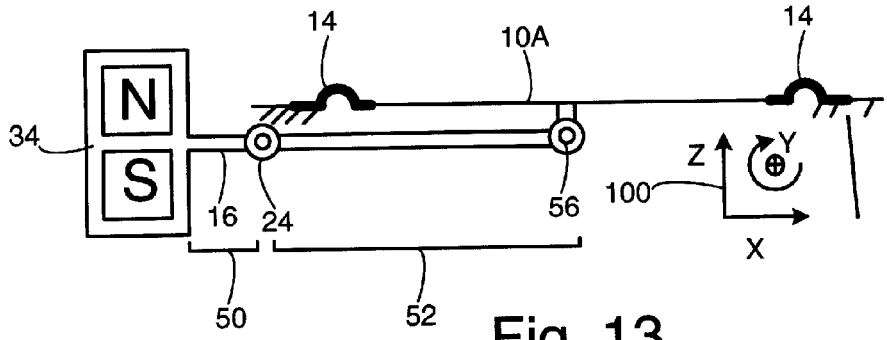
FIG. 13 is a view of the assembly of FIG. 9A with an additional feature.
Figure 14A:
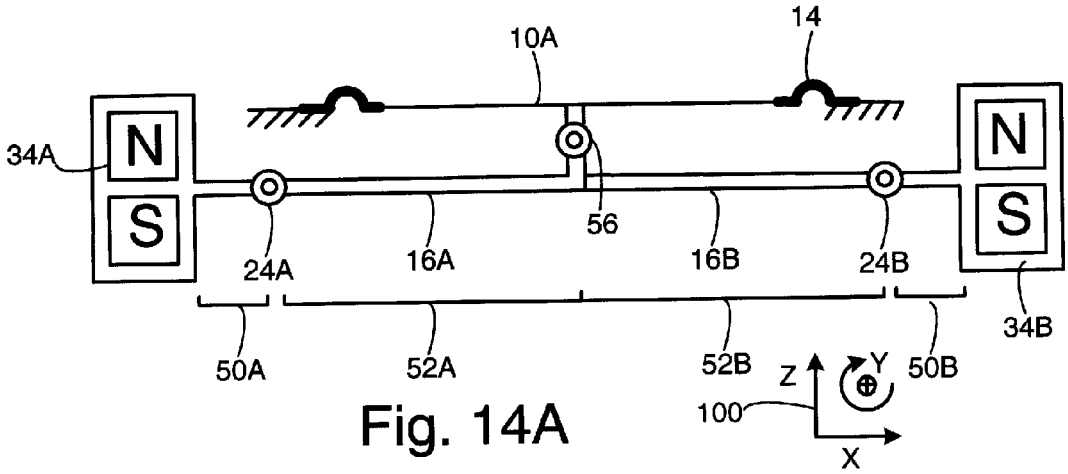
FIGS. 14A-14C show variations of the structure of FIG. 11.
Figure 14B:
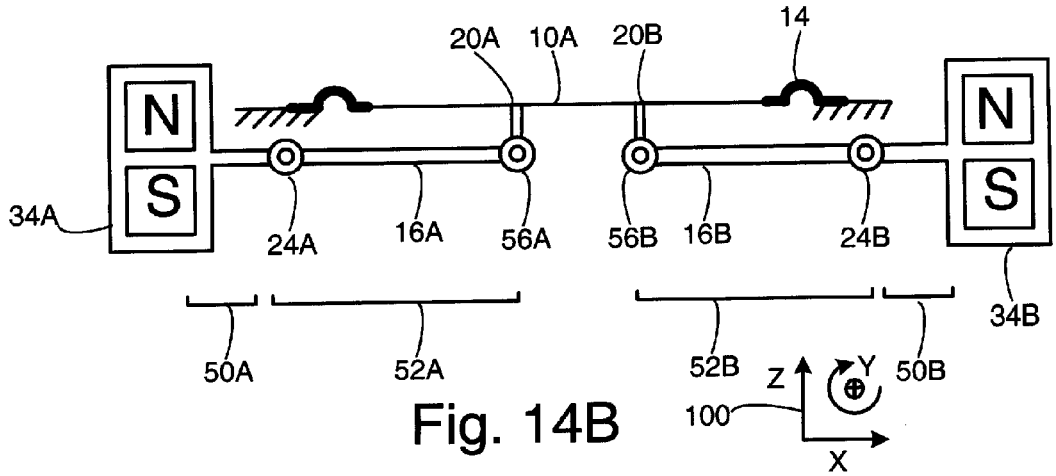
Figure 14C:
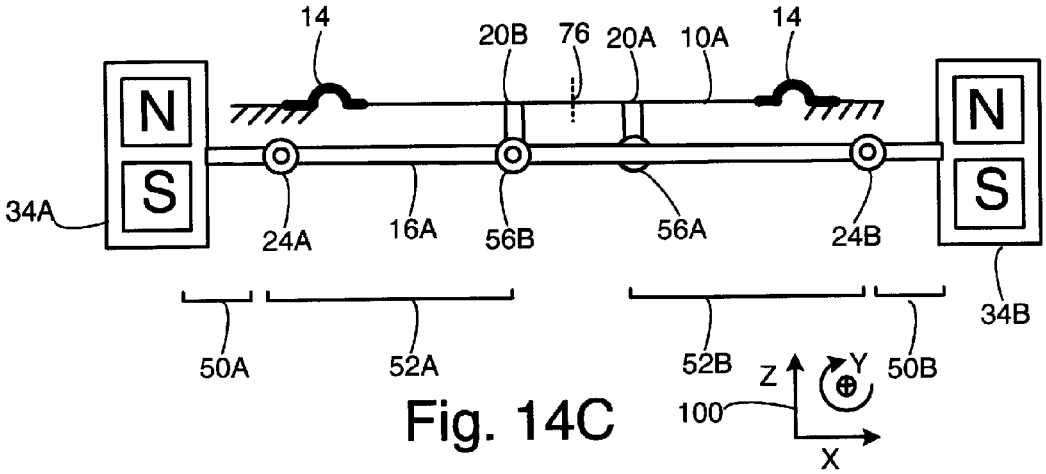

FIG. 13 shows the assembly of FIG. 9A with an additional feature. The cone type diaphragm 10 of FIG. 9A is replaced by a planar diaphragm 10A, mechanically coupled by suspension element 14 to surrounding structure (not shown). Similarly, FIG. 14A shows the loudspeaker of FIG. 11 with the diaphragm 10 of FIG. 14 replaced by a planar diaphragm 10A mechanically coupled by a suspension element 14 to surrounding structure (not shown). FIG. 14B shows the loudspeaker of FIG. 14A with force application points 20A and 20B at different points on the diaphragm. FIG. 14C shows the structure of 14B, except that the lever arms 16A and 16B cross in the X-direction, or in other words the force application point 20A of lever arm 16A is beyond the diaphragm midpoint 76 in the direction toward pivot 24B, and force application point 20B of lever arm 16B is beyond the diaphragm midpoint 76 in the direction of pivot 24A. FIG. 12B shows an isometric view of an implementation of the configuration of FIG. 14C, except that the implementation of FIG. 12B uses a cone-type diaphragm instead of the planar diaphragm of FIG. 14C.

The configuration of FIGS. 12B, 14B, and 14C can be usefully employed to prevent "rocking" behavior of the diaphragm. Rocking behavior is rotation about the X-axis and/or the Y-axis of the diaphragm 10A. With the configuration of FIGS. 12B, 14B, and 14C, the two motors of which each of magnet structures 34A and 34B are a part can be wired in parallel, so that the components of the forces applied the Z-direction at points 20A and 20B are in phase. In-phase force application in the Z-direction of the at different points on the diaphragm stimulates desired planar, non-rocking motion of the diaphragm. If there is rocking behavior, due, for example, to non-linear behavior of the surround 14, the rocking motion would be in opposition to the motion of the force application points 20A and 20B, resulting in back electromotive force (EMF) in the motor associated with the force application points. The back EMF dampens the rocking behavior.

Figure 15:
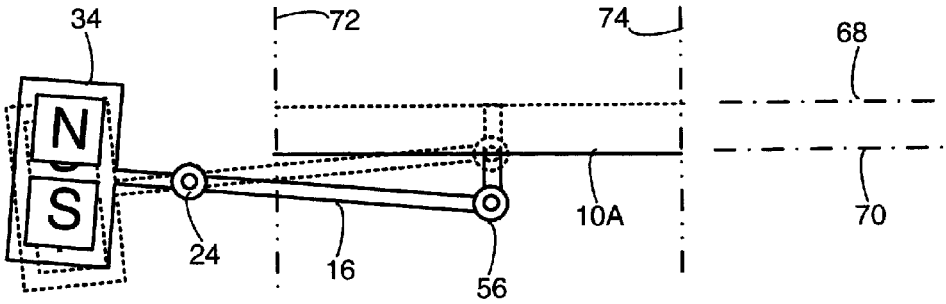
FIG. 15 illustrates an advantage of the structure of FIGS. 13, 14A, and 14B.

FIG. 15 illustrates an advantage of the implementations of FIGS. 13, 14A, 14B and 14C. In operation, the lever arm 16 oscillates about pivot 24 to cause the diaphragm 10A to oscillate between an extreme upward position (dotted line) and an extreme downward position (solid line), defining a full range of operation in the Z-direction bounded by planes 68 and 70 normal to the Z-axis and within an envelope in the X-direction and the Y-direction defined by lines, for example lines 72 and 74 extending from the edges of the diaphragm in the direction of motion of the diaphragm. In operation, portions of the armature, for example the magnet structure 34, can be outside the envelope in the X-direction and the Y-direction in the space between planes 68 and 70 over the full range of operation of the loudspeaker. A loudspeaker according to FIGS. 13, 14A, 14B, and 14C could be implemented in situations in which it is desirable to keep the Z-dimension small, for example a pocket sized electronic device such as a cell phone, personal data assistant, communication device, pocket sized computer, or the like. The loudspeaker of FIG. 13 is moment balanced and the loudspeakers of FIGS. 14A, 14B, and 14C are moment balanced and torque balance, which means that if used in a pocket sized electronics device, the device vibrates less when in operation than similar devices that are not moment balanced, torque balanced, or both. Additionally, the loudspeakers of FIGS. 13, 14A, 14B, and 14C have only one diaphragm. Therefore, in the loudspeakers of FIGS. 13, 14A, 14B, and 14C all the acoustic energy from the device could be radiated from one side of the device, so the device could provide full acoustic performance when used, for example, laying flat on a table, as oppose d to a loudspeaker having diaphragms radiating from both sides of the device. If implemented on a larger scale, other situations in which it is desirable to keep the Z-dimension small and in which it is desirable for all acoustic energy to be radiated from one side of the device would be a car package shelf or a car door or for a loudspeaker mounted in a wall of a room to radiate sound into the room. The surround 14 of previous figures is omitted in this view.

Figure 16:
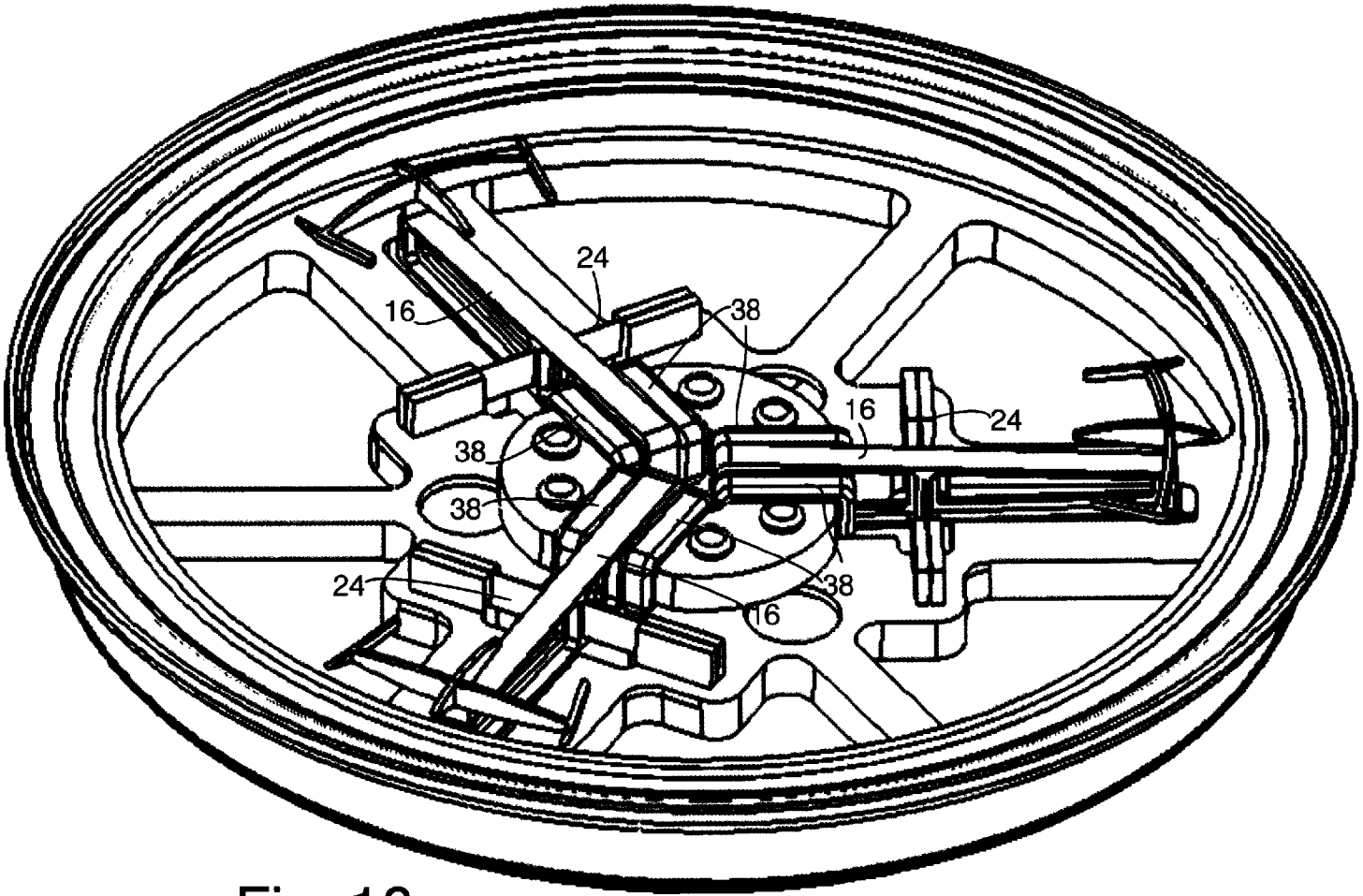
FIG. 16 is an isometric view of a moment balance and torque balanced loudspeaker.

FIG. 16 is an isometric view of a moment balanced and torque balanced loudspeaker, illustrating the fact that torque balancing can be implemented with more than two subassemblies each of which includes a magnet structure, a lever arm, and a pivot. FIG. 16 also illustrates the fact that a moment balanced and torque balanced loudspeaker can be implemented with an odd number of subassemblies and with more than two subassemblies. In the implementation of FIG. 16, no one magnet structure, lever arm, and pivot subassembly cancels out the free body torque of any one other magnet structure, lever arm, and pivot subassembly. However, in operation, the net result of the operation of all the motor and lever arm subassemblies is that the total resultant free body torque due to all of the motor and lever arm assemblies is less than the free body torque due to any single of motor and lever arms singly. The implementation of FIG. 16 uses a torsion flexure instead of the X-flexure of other implementations.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. A loudspeaker, comprising:

a moving magnet motor, comprising an armature comprising a magnet carrier;

a lever arm, coupling the armature and a pivot;

the lever arm further coupling the armature and an acoustic diaphragm to transmit motion of the armature to the acoustic diaphragm to cause the acoustic diaphragm to move.

2. The loudspeaker of claim 1, wherein the lever arm couples the armature to the acoustic diaphragm to cause the acoustic diaphragm to move in an arcuate path.

3. The loudspeaker of claim 1, further comprising a surround mechanically coupling the acoustic diaphragm to an acoustic enclosure and pneumatically sealing one side of the acoustic diaphragm from the other, wherein one side of the surround is wider than another side.

4. The loudspeaker of claim 1, further comprising a pivot coupling the lever arm to the acoustic diaphragm that permits the acoustic diaphragm to move in a pistonic manner.

5. The loudspeaker of claim 4, wherein the pivot coupling the lever arm to the acoustic diaphragm comprises a flexure.

6. The loudspeaker of claim 5 wherein the pivot coupling the lever arm to the acoustic diaphragm is compliant in a direction perpendicular to the axis of rotation of the pivot.

7. The loudspeaker of claim 1, wherein the pivot comprises a flexure.

8. The loudspeaker of claim 7, wherein the flexure is an x-flexure.

9. The loudspeaker of claim 8, the x-flexure comprising deflectable planar pieces having opposing edges encased in plastic.

10. The loudspeaker of claim 8, wherein the flexure is formed by insert molding.

11. The loudspeaker of claim 7, flexure having a dimension in the direction of the axis of rotation of the flexure that is greater than 50% of the length of the lever.

12. The loudspeaker of claim 1, wherein the pivot is compliant in a direction perpendicular to the axis of rotation of the pivot.

13. The loudspeaker of claim 1, wherein the lever arm and the magnet carrier are a unitary structure.

14. The loudspeaker of claim 1, wherein the pivot point is intermediate the armature and the acoustic diaphragm.

15. The loudspeaker of claim 1, wherein the armature is intermediate the pivot and the acoustic diaphragm.

16. The loudspeaker of claim 1, the moving magnet motor applying force to the lever arm in a non-contact manner.

17. A loudspeaker, comprising:

an acoustic diaphragm;

a force source; and a lever arm coupling the force source and the acoustic diaphragm, wherein the lever arm comprises a part of the force source, wherein the force source is a moving magnet motor comprising a magnet structure and wherein the lever arm comprises the magnet structure.

18. The loudspeaker of claim 17, further comprising a pivot comprising an x-flexure.

* * * * *